US007832341B2

(12) United States Patent
Walsh, Jr.

(10) Patent No.: US 7,832,341 B2
(45) Date of Patent: Nov. 16, 2010

(54) MERGING COMBUSTION OF BIOMASS AND FOSSIL FUELS IN BOILERS

(76) Inventor: William Arthur Walsh, Jr., 250 No. Bay St., Manchester, NH (US) 03104

( * ) Notice: Subject to any disclaimer, the term of this patent is extended or adjusted under 35 U.S.C. 154(b) by 10 days.

(21) Appl. No.: 12/386,756

(22) Filed: Apr. 22, 2009

(65) Prior Publication Data

US 2009/0274986 A1 Nov. 5, 2009

Related U.S. Application Data

(60) Provisional application No. 61/125,995, filed on Apr. 30, 2008.

(51) Int. Cl.
*F23H 3/02* (2006.01)
*F23D 1/00* (2006.01)
*F23K 3/02* (2006.01)

(52) U.S. Cl. ..... 110/104 B; 110/265; 110/110

(58) Field of Classification Search ..... 110/104 B, 110/261, 263, 264, 265, 347; 431/8
See application file for complete search history.

(56) References Cited

U.S. PATENT DOCUMENTS 4,314,670 A 2/1982 Walsh, Jr.
4,428,727 A * 1/1984 Deussner et al. ..... 110/261
5,178,533 A * 1/1993 Collenbusch ..... 431/8
5,261,602 A * 11/1993 Brent et al. ..... 110/347
6,986,311 B2 1/2006 Vatsky
7,305,924 B2 12/2007 Steffl et al.
2004/0123784 A1 7/2004 Satchell, Jr.
2005/0252430 A1 11/2005 Satchell, Jr.

* cited by examiner

*Primary Examiner*—Kenneth B Rinehart
*Assistant Examiner*—David J. Laux

(57) ABSTRACT

A method of injection and combustion control and related injection nozzles and lances are described which facilitate the merging of the combustion of fossil fuels and separately added solid biomass waste product fuels in the form of pelletized chars and fine particulates. An assembly of five concentric, annular tubes and conically shaped exit tips is used to deliver air conveyed biomass fuel as an annular stream between two higher velocity air streams, both of which converge so as to accelerate and propel the biomass fuel, and distribute it into the flame zone produced in a conventional fossil fueled boiler. The additional air required for combustion of the biomass fuel is fed to the expanding plume produced by the fuel delivery stream and adjoining air streams. A portion of the combustion air is delivered through the inside of the inner tube in sufficient volume to provide the entrainment flow produced by the expanding air streams.

2 Claims, 1 Drawing Sheet

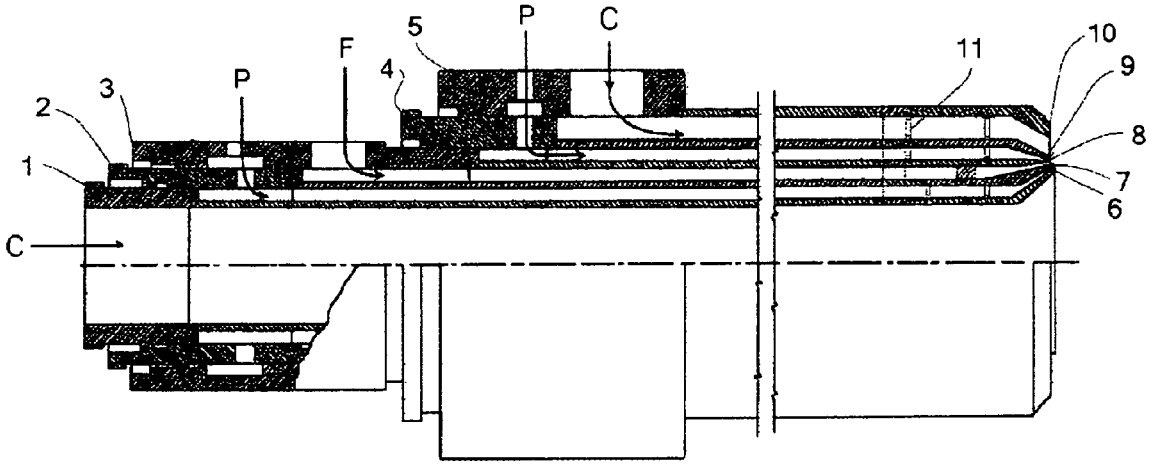
1
2
3
P
F
4
5
P
C
11
10
9
8
7
6
C

MERGING COMBUSTION OF BIOMASS AND FOSSIL FUELS IN BOILERS

CROSS REFERENCE TO RELATED APPLICATIONS

This application claims the benefit of PPA Ser. No. 61/125,995, by the present inventor, Apr. 30, 2008.

BACKGROUND OF THE INVENTION

1. Field of the Invention

This invention relates to a method and means of burning biomass fuels together with fossil fuels for the purpose of achieving a net reduction in the quantity of carbon dioxide emitted to the atmosphere by partially replacing the quantity of fossil fuel burned with a fuel that, as it is naturally replenished, absorbs $CO_2$, while simultaneously reducing the quantity of methane and other gases emitted into the atmosphere from biomass landfills.

2. Description of the Prior Art

The worldwide recognition of the contribution of fossil fuel combustion to the increasing atmospheric carbon dioxide levels has prompted the utility industry to seek steps to reduce its emissions. A number of programs have been proposed, some of which are currently under development. These generally consist of methods of removing and collecting the $CO_2$ from the flue gas for deep ground or sea burial. All such steps involve considerable capital and operating costs that would result in significantly increased cost to the consumer. One relatively simple approach that has merit is the substitution of a portion of the fossil fuel in utility and industrial boilers burning coal or oil with waste biomass materials. The amount of fossil fuel that can be replaced with biomass in existing fossil fuel boilers is generally limited to the order of 15% because of equipment design limitations. Such substitution would thereby provide about 10% of the energy produced. Based partially on its high percentage of moisture, biomass fuel heat content is about two thirds that of the fossil fuel it replaces. Nevertheless, it would make a significant contribution to the emission reduction of both $CO_2$ and, as mentioned above, methane, which has a significantly higher effect on global temperature.

Biomass, particularly that which is produced from waste wood and is relatively dry and size reduced, is currently being fed to power plant and industrial boilers along with coal. Biomass-waste fuels are also currently being produced from a wide range of vegetative sources. Since their physical and chemical properties vary widely, depending upon the source and type of processing, the methods used to feed or inject them into the combustion zone of a fossil-fueled boiler are also varied. Biomass materials are also produced as chars from the extraction of usable chemicals by pyrolysis. Some chars can be fully dried, micronized and pre-mixed with finely ground coal particles for simultaneous combustion. Others can be pelletized for separate feeding with only partial drying. In the latter case, in order to avoid localized zones of excessively high biomass fuel concentration, with humidity and temperature variation, it would be desirable to be able to inject and distribute the pellets throughout the cross-section of the fossil fuel combustion. On the other hand, it is desirable to maximize the feed rate at particular locations so as to minimize the number of fuel feeders or injectors needed (requiring costly boiler wall modifications). In order to distribute the injected biomass fuel from such individual injection points, its acceleration and propulsion is desired. It is also desirable that the air needed for combustion of the biomass fuel be mixed with it during injection so that its combustion does not locally reduce the air needed for the burning fossil fuel particles carried in the flame.

Although several patents searched by the applicant appeared to relate to the subject matter, method or means of the present application, detailed examination of them revealed that none appeared to dominate or read on its disclosure, or anticipate its claims, with the possible exception of the applicant's prior patent, "Variable Gas Atomization," U.S. Pat. No. 4,314, 670, Feb. 9, 1982. Although their concentric annular nozzles are generally similar, their functions, and the details of the exit configurations so required, are distinctly different. With VGA nozzles, the function is to produce a region of atomization within the zone of maximum mass velocity, which occurs at a nozzle throat, by the action of high velocity compressed air flowing on both sides of a liquid sheet flowing at lower velocity. In the present invention, the concentric annular streams are directed so as to contact the solid particles externally to the nozzle exit. Accelerating solid particles that are large in comparison to the droplet sizes desired with atomization, by contact within a nozzle having an exit width sufficient to pass the particles, requires excessive quantities of compressed air. With VGA nozzles, air is typically compressed to pressures higher than 15 psig, which thereby produces sonic throat velocity and throat pressure above ambient, plus turbulence and eddy formation. In the present invention, these effects are contra-indicated in the interest of maximizing the acceleration in generally axial direction. Pressures less than 15 psig are therefore employed. The energy of the high velocity air stream is thereby primarily directed toward particle acceleration. It is noted that U.S. Pat. Nos. 5,178,533 and 4,428,727 employ a series of concentric annular feed channels to deliver fuel and air for the purpose of combustion. In both cases, however, the nozzle exits are provided with means for producing rotation, swirling and eddies. Since swirling the flows upon exit produces centrifugal force, which is also contra-indicated for axially directed acceleration, the above cited patents are not considered to be relevant prior art

SUMMARY OF THE INVENTION

In accordance with the present invention, a method and fuel injection apparatus is provided to better enable pelletized and/or finer solid particulate biomass fuel to be burned together with fossil fuels in utility and industrial boilers. The biomass fuel matter, conveyed in an air stream, is accelerated, propelled and distributed, as it is being mixed with two higher velocity air streams plus additional, entrained combustion air, into the flame zone of the fossil fuel. Control of the acceleration, propulsion and mixing is achieved by injecting the air-conveyed solid fuel as an annular stream in the form of a hollow cone together with two annular, higher velocity streams flowing at less than sonic velocity (i.e., delivered as air compressed to less than 15 pounds per square inch, gauge pressure), one on each of the fuel conveyed stream and flowing in the same general direction while converging so as to produce the desired acceleration and propulsion of the solid fuel. Support and control of the combustion of the biomass fuel together with the fossil fuel is achieved by injecting low pressure air (i.e., from a blower) in the form of two additional streams, one on the opposite side of each of the two annular compressed air streams, in a manner that causes them to be entrained into the expanding annular plume of injected fuel. The current invention thus distributes the biomass fuel more uniformly throughout the fossil fuel flame zone during the combustion process and thereby reduces the formation of localized combustion zones that can adversely affect the boiler performance.

BRIEF DESCRIPTION OF THE DRAWING

The drawing shows an assembly, with the upper half cut away to show the essential features of this invention, of a wall-mounted nozzle assembly that is used for injecting biomass fuel in the form of small pellets or finer solid particulate into the flame zone of a fossil fuelled boiler.

DESCRIPTION OF THE PREFERRED EMBODIMENTS

The present invention provides a solution to these two opposing goals. It employs an annular, cylindrical nozzle to add biomass fuel to an existing fossil-fueled boiler by injecting, accelerating and propelling it into the fossil fuel flame zone together with the air needed for its combustion. It serves to distribute the biomass fuel for merging its combustion that of the fossil fuel. By providing large-volume fossil fuel delivery rates, it minimizes the number of boiler wall entry ports required for inserting fuel burner nozzles. The fuel injection method and means are particularly applicable to the partial replacement of fossil fuels with biomass fuels for their joint combustion in utility and industrial boilers.

The drawing illustrates an assembly of a typical nozzle for simultaneous combustion of biomass and fossil fuels, as used to deliver, inject, accelerate and propel biomass fuel in the form of solid pellets and/or finer solid particles in accordance with the method and teachings of this invention. The assembled nozzle consists of a series of concentric, circular cylindrical sub-assemblies. The sub-assemblies form four concentric channels for delivery of fuel and air. As illustrated, the upper half is shown fully cut away along the centerline in order to show the inner construction. Since, as typically installed by insertion through a boiler wall or "wind-box," the overall length would be longer than illustrated, the central portion the concentric cylinder assembly has also been cut away, leaving the differing inlet and exit end portions. While it employs a nozzle configuration similar to that of the applicant's earlier patent, "Variable Gas Atomization," U.S. Pat. No. 4,314,670, (referred to herein as VGA), it utilizes the configuration to produce the preferred annular flows in a distinctly different manner: it employs compressed air to accelerate and propel previously divided solid matter rather than to breakup an annularly flowing sheet of liquid matter into fine liquid droplets.

Referring to the drawing, the inlet end of the five subassemblies are labeled 1, 2, 3, 4 and 5, respectively. Also labeled are the respective flows of combustion air, C, air-conveyed, solid-fuel pellets or fine particulate, F, and fuel propulsion air, P. The various flows are delivered through inlet ports to the respective channels formed by the concentrically assembled cylindrical subassemblies to the opposite, exit end of the assembled nozzle. The inlet end of each sub-assembly consists of heavier walled tubing welded to the end of the delivery tube. The heavier walled portions are employed in order to accommodate attachment of conventional pipe fittings and to facilitate machining of mating surfaces to provide the addition of commercially available seals and means of providing for their relative axial movement and positioning.

Referring now to the opposite end of the nozzle, the five delivery tubes are fitted with five heavier walled exit tips labeled 6, 7, 8, 9 and 10. The exit tips are suitably machined so as to direct the respective exit flows in a desired, relatively converging, forward direction while, at the same time, allowing variation of the widths of the annular exit openings through axial movements of the separate subassemblies. Concentricity between the individual exit tips of the nozzle is maintained by the use of radial spacers, such as that labeled as 11, that are formed with ports to that allow air and fuel passage. These can be either a part of the individual tips or added as commercially available components such as roller bearings and raceways.

The biomass fuel, in the form of pellets of sizes up to at least one quarter inch and/or other similar, or smaller sized particulate, is air conveyed through the annular channel between tubes 2 and 3 at the appropriate velocity, i.e., as required for conveyance (estimated to be approximately 70-100 ft./sec. for solid pellets having a bulk density of 20 lbs/ft$^3$). Axial position adjustment of tube 3 is employed to vary the width of the fuel exit annulus as needed to accommodate the largest pellet size. In addition to pellets, finely ground particles of flaked or fluffed waste materials of similar sizes can also be accommodated.

Additional, moderately compressed, air (generally 5 to 15 psig) is delivered through the two annular channels adjacent to the fuel delivery channel (formed between tubular subassemblies 1 and 2, and between 3 and 4). The two compressed-air-flow streams exit the nozzle in the form of thin annular sheets at velocity higher than that of the fuel exiting the nozzle tip. The two annular air jets are directed at narrow angles relative to that of the fuel exit. The two compressed air flows serve the purpose of accelerating the discharged pellets and/or smaller particles, propelling and distributing the biomass fuel into the flame zone of the burning fossil fuel. Axial adjustments of tubular sub-assembly 2, relative to 1, and 4, relative to 3, vary the propulsion air flows.

Since compressed air, as it is released from an elevated pressure, entrains surrounding, ambient air, it can also be used to assist in entraining combustion air into both sides of the hollow cone (which expands as its velocity decreases after exit) of the annularly fed, air-conveyed fuel and higher velocity air. The volume of air required for combustion, which is much greater than the amounts conveying the fuel or furnished as compressed air, is therefore delivered by a combination of additional means. A portion of it is supplied through the inner pipe to be entrained into the annularly exiting fuel by the adjoining compressed air. As such it prevents the recirculation of gases and fuel from the flame zone that would otherwise be produced by the entrainment demanded by the adjoining annular air jets. The balance of the air is delivered for similar entrainment through the outermost annular channel, formed by concentric tubes 4 and 5. Where nozzles are installed within an existing windbox as replacements for fossil fuel combustion nozzles, the combustion air delivered through the wind box is used to supplement that of the outer tube. Alternatively, outer tube and nozzle tip assembly 5 may be omitted, and the wind-box modified as required to meet the outer combustion air delivery needs.

The cone angles of the several tips are site-selected to suit the properties of a specific fuel and the flame pattern desired within the combustion chamber; i.e., either a long narrow pattern that extends a distance from the chamber wall or one with a wider cone angle and shorter flame. In early combustion tests of a VGA conical nozzle used to finely atomize micronized coal-oil and coal-water mixture fuels, several cone angles were assessed. A desired, short flame pattern was thus achieved, producing complete burnout within a short distance from the nozzle. Comparative tests of other, competitive nozzles produced elongated flame patterns, but did not achieve complete burnout.

A listing follows of some typical nozzle sizes, together with approximate capacities and energy outputs, plus the parasitic energy consumed in combustion and propulsion air supply. No estimate has been made of the energy requirement for fuel transfer to the nozzle entry. While this is a significant additional cost, it is one that varies with the fuel properties, transport distance and complexity of the equipment involved in the associated external delivery system.

A range of nozzle sizes are specified herein for illustrative purposes, and are referred to as sizes I, I, III and IV, based on their outside diameters. The outside diameters and inside (core clearance) diameters of the nozzles in inches are tabulated as follows:

| | MODEL: | | | |
|---|---|---|---|---|
| | I | II | III | IV |
| Outside diameter: | 8.62 | 10.00 | 12.00 | 16.00 |
| Diameter, less outer pipe: | 6.62 | 8.00 | 10.00 | 12.75 |
| Inside core clearance diameter: | 1.50 | 2.50 | 4.02 | 6.06 |

The correspondingly reduced nozzle diameters (less outer pipe) are also shown for the case where an existing windbox is used in supply of combustion air and an outer nozzle channel for combustion air delivery is not needed,.

The fuel delivery capacity and the corresponding energy output for each nozzle size vary widely, depending on a number of factors. Among the variables are the following;

The properties of the fuel, including the heat of combustion, the moisture content and the bulk density The weight of biomass fuel that is conveyed per unit weight of carrier air, commonly expressed as the solids/air ratio, which generally ranges from 3-10

The minimum air velocity required to convey the fuel particles, which is a function of the fuel density The air pressures available both for the combustion air and the fuel conveying air.

Based upon a fuel bulk density of 20 lbs/ft$^3$, a fuel delivery at a solids/air weight ratio of 3 and an allowable combustion air delivery pressure loss of 1 psi, preliminary estimates of operating conditions for the four nozzle sizes are as follows:

| | MODEL: | | | |
|---|---|---|---|---|
| | I | II | III | IV |
| Combustion air, scfm: | 2600 | 4200 | 7500 | 22000 |
| Fuel rate, lbs/hr: | 1950 | 3150 | 7400 | 16500 |
| Thermal Output, MWth: | 4.6 | 7.4 | 13 | 39 |
| Electric Output (at Eff. = 0.3), MWe: | | | | 12 |
| Parasitic Power, Combustion Air, MWe: | | | | .14 |
| Parasitic Power, Propulsion Air, MWe: | | | | .08 |
| Parasitic Power, Percent of Output Power, MWe: | | | | 1.8% |

With increased solids/air weight ratio, or with higher fuel densities, the nozzle capacities may be increased, while requiring increased combustion air and somewhat higher air pressure. The additional combustion air required may be furnished by supplementing the nozzle-delivered air with that furnished in a conventional windbox installation. The annular, sheet-forming exit flow of pelletized or finer particulate fuel, plus the concentric flows of propulsion and combustion air, permits both a wide range of nozzle sizes and a wide turndown ratio to be employed. The ability to select the conical divergence angle of the nozzle exit tips permits the flame pattern to be designed to suit the combustion chamber needs. In minimizing the number of both the biomass fuel injectors and the wall locations required for distributing the fuel throughout the flame zone of a conventional fossil fueled boiler, operational control of the biomass burners is simplified, and boiler retrofit cost is minimized. Patterned after conical VGA nozzles successfully operated in combustion of viscous and erosive coal-water and coal-oil fuels, the versatility of the newly developed injection nozzle commends it to a wide range of biomass fuels and combustion chamber designs. This new method of biomass fuel injection and nozzle design provides a means of economically retrofitting diverse types and sizes of combustion chambers so as to enable them to burn a variety of biomass fuels together with fossil fuels. This and all such variations which would be obvious to one skilled in the art are deemed to be within the spirit and scope of the appended claims except where expressly limited otherwise.

While not a claim of this patent application, it is noted that somewhat similarly constructed nozzles, such as described in the VGA patent, can be employed to atomize and inject fuels consisting of combustible viscous liquids such as waste industrial oils, concentrated municipal sludge and micronized coal-oil, coal-water and oil-biomass mixtures. Such fuel variations, if of sufficiently high heat content, may also be used to enhance the combustion energy output of biomass fuel boilers, e.g., boilers employing wood fuels with high moisture and correspondingly low energy content.

I claim:

1. In a nozzle assembly consisting of a series of circular, cylindrical tubes assembled to provide concentric annular channels for the passage of fluids, a method of injecting, accelerating and propelling solid biomass fuel pellets, which generally have a diameter, or other maximum dimension, shape or surface characteristic that prevents passage through the nozzle, of at least 0.25 inches or other, finer, solid, biomass fuel particulate matter, together with the additional air required for complete combustion of the injected fuel, into the flame zone of a combustion chamber burning fossil fuel in a manner that provides controlled, merged combustion of the fuels, comprising the following steps:

a) forming an annular nozzle-exit stream of carrier-air-conveyed solid biomass fuel consisting of pellets and/or other fine particulates;

b) forming two annular, nozzle-exit streams of adjoining air, flowing at nozzle exit velocities higher than that of the biomass fuel bearing stream, but less than sonic velocity (upstream delivery pressures less than 15 psig.), adjacent to the biomass conveying stream, one on each side of it, flowing in substantially the same direction but directed so as to immediately converge with it at a small relative angle;

c) forming a cylindrical stream of air that exits along the central axis of the annular nozzle at a lower velocity than the adjoining air streams, which provides a portion of the biomass combustion air, assists in the forming and controlling of the shape and length of the biomass fuel flame zone and furnishes the air for entrainment by the flow of higher velocity adjoining air that would otherwise be re-circulated back along the nozzle axis from the flame zone in the form of undesirable eddy current recirculation of combustion gases and particulates;

d) forming an annular nozzle exit stream of additional combustion air, located radially outward from the outer of the two adjoining air streams, and flowing in substantially the same direction as the other streams, but directed so as to immediately converge with them in sufficient quantity to complete the biomass fuel combustion, and to assist in the forming and controlling of the shape and length of the biomass fuel flame zone;

e) adjustably controlling the widths of the exit streams, the quantities flowing, the acceleration and propulsion of the solid biomass fuel and the shape and length of its flame zone to suit the physical properties of the biomass fuel.

2. A biomass fuel injection nozzle assembly comprising:

a) five concentric, circular, cylindrical-tube subassembly members, identified for reference herein as members (1), (2), (3), (4) and (5), in order of their increasing diameters, forming an axially central cylindrical channel and four concentric annular channels;

b) each subassembly tube being permanently attached at one end to a heavier walled cylindrical section fitted with ports allowing passage of fluids to the respective annular channels and fitted to allow relative axial movement of the respective subassemblies;

c) each subassembly tube being attached at its opposite end to removable exit nozzles, identified for reference herein as members (6), (7), (8), (9) and (10), in order of their increasing diameters;

d) the annular channel formed by members (2) and (3) being assigned to delivery of air conveyed biomass fuel pellets or finer particulates;

e) the annular channels formed by members (1) and (2), and by members (3) and (4), being assigned to delivery compressed air;

f) the axially central channel formed by member (1) and the annular channel formed by members (4) and (5) being assigned to delivery of combustion air;

g) the outer and inner surfaces of exit member (8) being equally tapered at a pre-selected angle ranging from 5 and 10 degrees at the nozzle exit tip to an annular exit tip width of 0.04 to 0.06 inches;

h) the outer surface of member (7) being flared outwardly at its exit end at a pre-selected angle ranging from 5 to 20 degrees relative to the nozzle axis and extending to a diameter equal to that of the inner diameter of the tubular portion of sub-assembly (3);

i) the inner surface of member (7) being similarly flared at an angle 10 degrees greater than that of its outer surface, and enlarged in diameter sufficiently to form an annular tip width of 0.04 to 0.06 inches;

j) the outer surface of member (6) being flared outwardly at its exit end at a pre-selected angle ranging from 5 to 10 degrees greater than the angle of the flared inner surface of member (7) and extending to a diameter of 0.1 inches less than that of the inner diameter of the end of member (7);

k) the inner surface of member (6) being similarly flared at an angle 5 to 15 degrees greater than that of its outer surface, and enlarged in diameter sufficiently to form an annular tip width of 0.04 to 0.06 inches;

l) the outer diameter of member (9) being decreased at a pre-selected angle ranging from 25 to 30 degrees relative to the nozzle axis at the nozzle exit and decreasing to a diameter equal to that of the outer diameter of the tubular portion of sub-assembly (3);

m) the inner diameter of member (9) being similarly decreased at an angle of 10 to 20 degrees relative to that of its outer surface and decreased in diameter sufficiently to form an annular tip width of 0.04 to 0.06 inches;

n) the inner diameter of member (10) being decreased at the nozzle exit end at the same angle as that of the outer end of member (9), to a diameter at its end equal to the outer diameter of the tubular portion of sub-assembly (4);

o) the outer diameter of member (10) being beveled at its end a 45 degree angle to a radial width at its end of 0.25 to 0.50 inches.

* * * * *